United States Patent [19]

Hoffman

[11] 4,060,914

[45] Dec. 6, 1977

[54] APPARATUS FOR TREATING MATERIAL WITH A GASEOUS MEDIUM

[75] Inventor: Charles E. Hoffman, Hatboro, Pa.

[73] Assignee: Proctor & Schwartz, Inc., Philadelphia, Pa.

[21] Appl. No.: 715,419

[22] Filed: Aug. 18, 1976

[51] Int. Cl.[2] ..... F26B 3/04; F26B 13/02

[52] U.S. Cl. ..... 34/219; 34/196; 34/160; 98/40 C; 98/40 N

[58] Field of Search ..... 34/156, 212, 158–160, 34/224, 225, 242, 219, 195–197, 231, 162; 126/21 A; 98/40 C, 40 N, 36; 432/175, 176, 162, 152, 185, 194, 201–203; 239/568

[56] References Cited

U.S. PATENT DOCUMENTS

| | | | |
|---|---|---|---|
| 2,339,365 | 1/1944 | Guilder | 34/231 |
| 2,896,335 | 7/1959 | Dungler | 34/160 |
| 3,236,170 | 2/1966 | Meyer et al. | 98/42 A |
| 3,429,057 | 2/1969 | Thygeson, Sr. | 34/160 |
| 3,739,490 | 6/1973 | Comstock | 34/162 |
| 3,739,491 | 6/1973 | Creapo et al. | 34/156 |
| 3,920,859 | 11/1975 | Foster | 34/196 |

FOREIGN PATENT DOCUMENTS

| | | | |
|---|---|---|---|
| 474,773 | 6/1951 | Canada | 98/40 C |
| 656,647 | 1/1938 | Germany | 98/40 C |
| 721,940 | 1/1955 | United Kingdom | 98/40 C |

*Primary Examiner*—John J. Camby
*Assistant Examiner*—Henry C. Yuen
*Attorney, Agent, or Firm*—Richard H. Thomas

[57] ABSTRACT

Shown is a baking oven or other gas treating apparatus having a novel gas distribution-box construction for circulation or impingement of a gaseous treating medium around or against goods conducted through the apparatus. The present invention is particularly applicable to the baking of baked goods, but also is applicable to the drying or treating of particulate material or webs of material and has other uses.

9 Claims, 10 Drawing Figures

APPARATUS FOR TREATING MATERIAL WITH A GASEOUS MEDIUM

The present invention relates to a gas treating apparatus for contacting a gaseous treating medium with goods conducted through the apparatus, and in particular to a novel gas distribution box construction for circulation or impingement of the gaseous treating medium around or against such goods. The present invention is particularly applicable to the baking of baked goods and will be described with reference to the same, although it will be apparent to those skilled in the art that the invention has other applications, such as the drying or treating of web-like and particulate materials in a drying apparatus.

BACKGROUND OF THE INVENTION

It is known to provide a baking oven, dryer or other gas treating apparatus in which the heating or drying air or gas is emitted through a series of gas distribution box nozzles positioned in succession along the path of travel of the goods being baked or web of material or layer of granular material to be dried or treated, each nozzle extending laterally across the goods or material. As such distribution boxes and nozzles are lengthened to accommodate ever greater and greater widths of gas treating apparatus, uniformity of treatment across the goods, web or layer of granular material becomes more and more difficult. The reason for this is that the treating air or gas normally has to be fed to each distribution box from one side of the gas treating apparatus. This means that the air or gas flowing from the distribution box nozzle may have a higher velocity adjacent the inlet side, or the opposite side depending upon the length of the box. Even if the distribution box is fed from the center of the apparatus, which may be awkward, the velocity of the flow from the distribution box nozzle varies being higher in the center of the nozzle. The result is that with conventional gas distribution boxes, the treatment or drying of the material being treated or dried is non-uniform.

In addition, particularly where the distribution box is fed from one side of the dryer or gas treating apparatus, the gas flow has a direction of movement away from the box inlet end and towards the exhaust side of the dryer. In the case of drying of carpeting and other such material, this tends to flatten the upstanding carpet tufts impeding the drying. In the case of granular material, it causes at least some of the granular material to shift to the exhaust side of the dryer resulting in an uneven layer of material passing through the dryer, and uneven drying.

In prior U.S. Pat. No. 3,429,057, assigned to assignee of the present application, an improvement was shown by which drying air or other treating gas was distributed uniformly across the entire width of the area to be dried or treated. This was accomplished by employing a pair of distribution boxes which were in side-by-side relationship, one of the distribution boxes being fed from one side of the dryer or gas treating apparatus and the other distribution box from the opposite side of the dryer. The streams of drying air (in the event the treating process was drying) which flowed from the distribution box nozzles tended to have opposite horizontal directions of movement which in turn created a myriad of small vortices perpendicularly impinging against the material being dried. This prevented laying over of the carpet or flow of particulate material to one side of the dryer, and thus resulted in more uniform drying of the material being treated. With regard to velocity or volume of flow, the flow from one of the distribution boxes compensated for differences in flow from the other distribution box, with the result that the merged streams had a substantially uniform velocity of flow and volume across the width of the carpet or granular material. This also resulted in more uniformity of drying or gas treating.

The invention of said prior patent was of particular importance in the drying of heat sensitive materials such as rugs having polypropylene backings wherein excessive temperatures (due to greater air flow) could melt the backing. The balancing of flows by the process of the prior invention enabled obtaining uniformities of air temperatures in dryers unknown prior to such invention.

The disclosure of prior U.S. Pat. No. 3,429,057 is incorporated by reference herein.

SUMMARY OF THE INVENTION

In accordance with the concepts of the present invention, there is provided an apparatus for treating with a gaseous medium material conveyed through the apparatus, the apparatus comprising a novel distribution box construction for dispensing the gaseous medium. The distribution box includes a plenum chamber having a longitudinal dimension and a lateral dimension with means for introducing the gaseous medium into the plenum chamber. A nozzle is provided substantially coextensive with the plenum chamber, in said longitudinal dimension, the nozzle also having a lateral dimension. A plurality of flow dividers divide the nozzle into a plurality of parallel, laterally extending straight channels each having an inlet and an exhaust end. Means defining an elongated, constricted slot substantially coextensive with the plenum chamber and the nozzle communicates the plenum chamber with said channel inlet ends.

By the distribution box construction of the present invention, the gaseous medium is emitted in a plurality of straight, parallel flow jets which are equal in amount and velocity across the width of the material being treated, resulting in more uniform drying or treating of the material being dried or treated. This also prevents flattening or laying down of carpet tufts, or shifting or piling of granular material to one side of the dryer or the other. In addition, it prevents overheating of portions of the material being dried or treated, of particular importance in the drying or treating of heat sensitive materials. In the case of baking ovens, the conventional oven uses radiation of heat for the baking operation. It is known that the use of moving, hot air results in improved baking. Possibly, the moving air accelerates baking, increasing moisture retention. However, the need for maximum uniformity of velocity and distrubution of the heating air should be evident. Such need is met by the apparatus of the present invention.

In an embodiment of the invention, the distribution box plenum chamber is tapered so that it is progressively smaller in cross-section in a direction away from the inlet end. This results in a more uniform pressure of the gaseous medium throughout the length of the plenum chamber, and thus a more uniform flow velocity from the distribution box nozzle.

BRIEF DESCRIPTION OF THE DRAWINGS

The invention and advantages thereof will become apparent from the following description, with reference to the accompanying drawings, in which.

Figure 1:
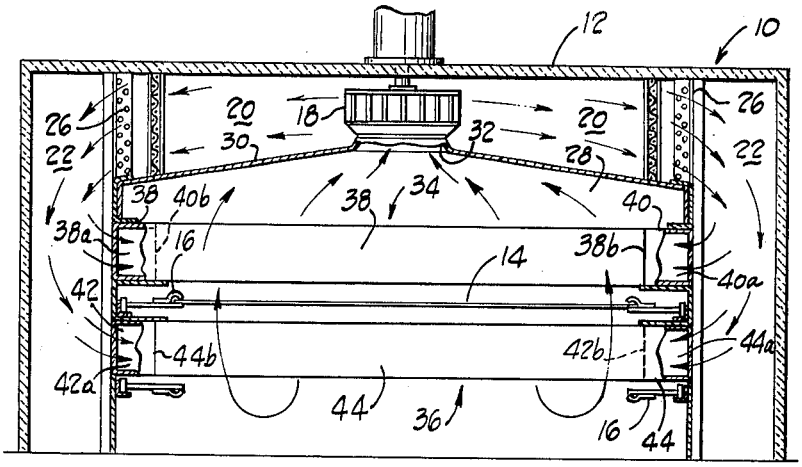
FIG. 1 is a section view of a baking oven or dryer utilizing a novel distribution box construction in accordance with the concepts of the present invention.

Referring to the drawings, and in particular FIG. 1, there is illustrated a baking oven or dryer 10 comprising a generally rectangular housing 12 through which goods or material are conveyed on conveyor 14 driven by a chain drive mechanism generally indicated with the number 16. For purposes of the present application, the goods or material being treated may comprise, by way of example, baked goods, sheet material, fabric, a batt of loose fibers, loose fibers and granular material.

The baking oven or dryer illustrated is of the recirculation type wherein heating air or other suitable gaseous medium is circulated through the housing 12 by means of a plurality of fans or blowers 18. The blowers discharge into a first plenum chamber 20 which is in fluid communication with a second plenum chamber 22, in the present instance, two plenum chambers located along opposite longitudinal sides of the housing. As in conventional practice, intermediate the first and second plenum chambers are filter screens 24 and heaters 26 to clean the air and impart heat thereto in order to more efficiently heat or dry the goods being heated as the same pass through the apparatus. As shown, the first plenum chamber 20 is separated from a suction chamber 28 through which the goods pass by a longitudinally extending bottom wall 30 through which suitable apertures 32 permit gas communication between the suction side of the blower 18 and the suction chamber 28.

At least a pair of blower pressure boxes 34 and 36, in the present instance a plurality of gas distribution boxes, are arranged on opposite sides of the plane of travel of the conveyor 14 and positioned transversely thereto, each containing means for receiving air from the plenum chamber 22 and emitting the air to opposite sides of the goods being treated to efficiently treat such goods. To this end, upper distribution box 34 comprises a pair of ducts 38 and 40 positioned adjacent one another and having air inlets 38*a* and 40*a* respectively, in fluid communication with the plenum chambers 22 located along the opposite sides of the housing 12 so that gaseous medium enters each duct of the pair from opposite sides. For instance, referring to the top pair of ducts 34, the duct 38 is in front of the duct 40, having exposed inlet 38*a*. It terminates short of the right-hand plenum chamber 22, depending on the width of conveyor 14, at closed end 38*b*, thus exposing the inlet 40*a* of the second duct. The second duct terminates short of the left-hand plenum chamber 22 at closed end 40*b* shown in dashed lines. In the lower pair of ducts 36, the sequence of location of the inlet ends 42*a* and 44*a* is simply reversed, duct 42 fed from the left being behind duct 44 from the right.

Figure 2:
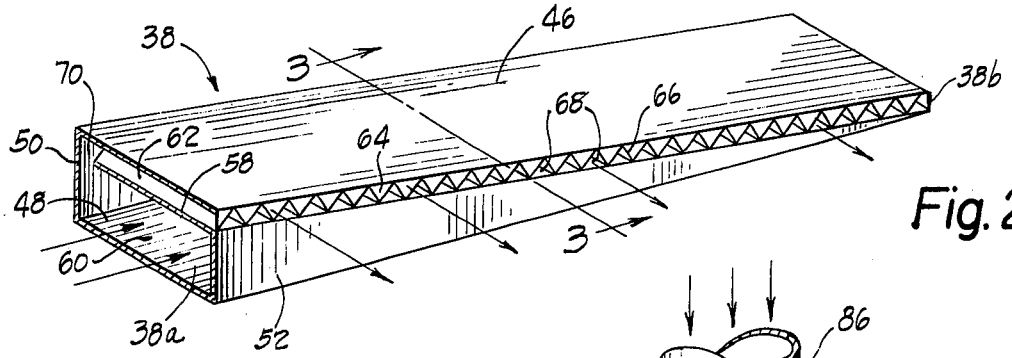
FIG. 2 is a perspective view of a distribution box of the dryer of FIG. 1 showing details of the construction of the box.
Figure 3:
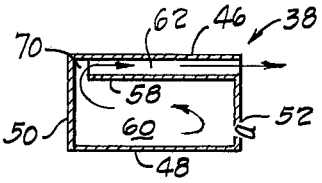
FIG. 3 is a section view taken along line 3—3 of FIG. 2.

Details of the distribution box duct construction are shown in FIGS. 2 and 3. In these Figures, duct 38 is shown. It is a generally elongated member which is rectangular in cross-section, the duct having opposed side walls 46 and 48, each of which is planar in shape (relatively flat) and rectangular. Opposed top and bottom walls 50 and 52 complete the duct sides. In a preferred embodiment, the distribution box is tapered, the side wall 46 converging towards the wall 48 to define a duct of progressively smaller cross-section proceeding from the open inlet 38*a* to a closed, opposite end 38*b*.

An internal baffle 58 disposed in a plane parallel to the duct side 46 separates the duct into a plenum chamber 60 and a distribution box nozzle 62, defining with the side 46 a nozzle of uniform cross-section. It is spaced close to the side 46 so that the nozzle is of relatively narrow width. The cross-sectional area of the plenum chamber 60, defined by the baffle 58 and the opposite nozzle wall 48 becomes progressively smaller in the direction of the housing taper.

The only openings in the distribution box are the inlet opening 38*a* at one end of the plenum chamber and the longitudinally extending nozzle opening 64 (FIG. 2) along the bottom side of the distribution box. A corrugated flow divider 66 is positioned in the nozzle establishing a plurality of parallel, straight flow channels 68 through which the drying air or treating gas travels. The divider extends substantially the full depth into the nozzle so that the channels have opposed inlet and exhaust ends, the latter being at nozzle opening 64. The corrugated flow divider may be held in place by any suitable means, such as by welding.

In the embodiment of FIGS. 2 and 3, it is apparent that the treating medium, for instance drying air, enters the plenum chamber 60 at the wide-mouth end 38*a*, traveling through the plenum chamber. The upper edge of the baffle 58 is spaced from the top wall 50 a small amount to define a longitudinally extending, constricted slot 70 through which the gas medium travels from the plenum chamber into the nozzle channels 68. By virtue of the relatively narrow, constricted slot, of uniform width, and the tapered construction of the plenum chamber, the flow from the plenum chamber into the nozzle channels is of relatively uniform velocity and amount. In the channels, the flow is straight so as to produce a plurality of relatively straight, flow streams of equal volume emanating from the nozzle. The width of the slot 70 is critical. It should be narrow enough to provide a pressure differential between the plenum chamber and the nozzle, at any point along the length of the distribution box. It is not critical that the plenum chamber be tapered, as a substantial improvement in obtaining a more uniform air flow results when only the constricted slot at the nozzle inlet is used.

Figure 4:
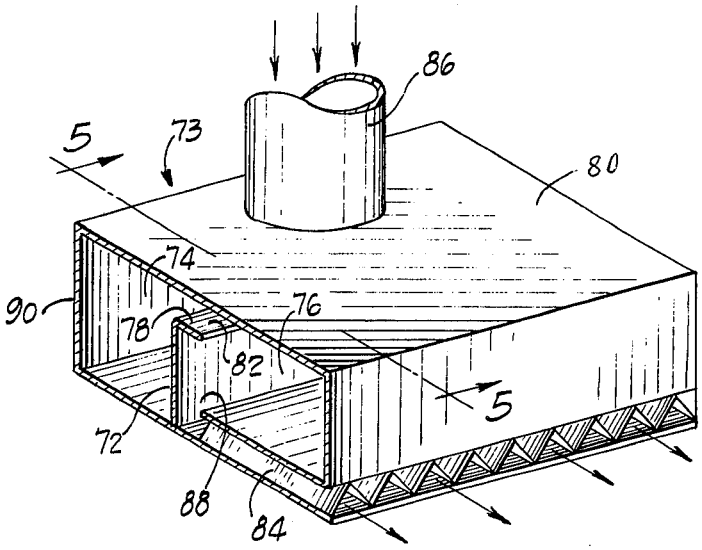
FIG. 4 illustrates a section of distribution box construction in accordance with an embodiment of the invention.
Figure 5:
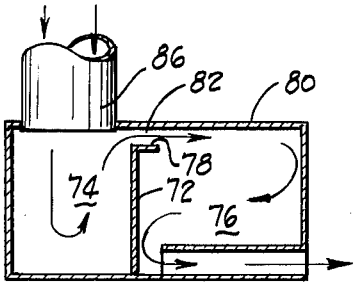
FIG. 5 is a section view taken along line 5—5 of FIG. 4.

In the embodiment of FIGS. 4 and 5, a baffle 72 is employed to divide the distribution box 73 into a pair of side-by-side plenum chambers 74 and 76. The top edge 78 of the baffle is spaced slightly from top wall 80 to define a narrow constriction 82 between the plenum chambers to establish a relatively uniform flow, with regard to both amount and velocity, along the length of the distribution box. The nozzle 84 is disposed in communication with the second plenum chamber 76 at a point spaced from the constricted opening 82. As shown in FIG. 5, the air flow is from an inlet 86 into the first plenum chamber 74, and from there through constricted opening 82 into the second plenum chamber 76, following a curved path into the distribution box nozzle 84. The location of the inlet end of the nozzle 84 relative the baffle 72 is such that the air has to travel through a second constricted slot 88 adjacent the nozzle inlet.

It is a feature of the embodiment of FIGS. 4 and 5 that the air inlet 82 for the distribution box is centrally located relative the longitudinal dimension (that dimension defining the width of the nozzle 80 from one end of the box to the other).

In the embodiment of FIGS. 4 and 5, the distribution box is disposed so that it provides an angled knife jet placed at an acute angle with regard to the plane of web material being treated or dried. This is why the inlet 86 is in wall 80, which is the uppermost wall. The inlet could as well be in wall 90 were the nozzle 84 to be aimed perpendicularly at the web surface. In either event, the flow into the first plenum chamber 74 could develop a direction of movement directly into the nozzle which would result in a greater nozzle air flow in the area of the inlet 86. The use of a second plenum chamber and a pair of constricted openings or slots between the inlet plenum chamber and nozzle prevents this from happening.

Figure 6:
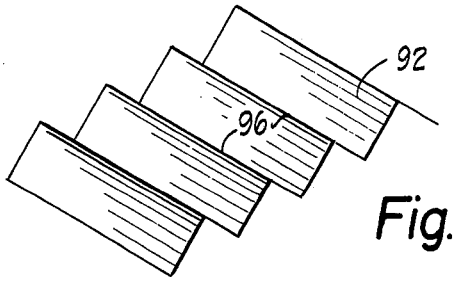
FIGS. 6, 7 and 8 illustrate alternate nozzle flow dividers in accordance with embodiments of the present invention.
Figure 7:
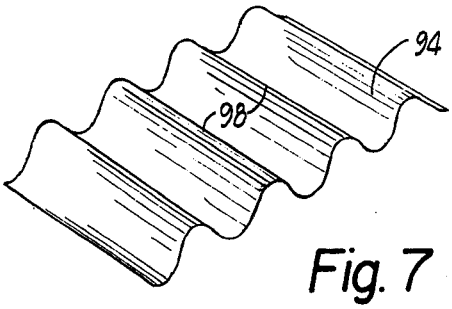

The flow dividers 92 and 94 of FIGS. 6 and 7 are substantially the same, being corrugated in nature, with the distinction being that the embodiment of FIG. 6 is provided with relatively pointed or sharp ridges 96, whereas the embodiment of FIG. 7 is provided with relatively rounded ridges 98.

Figure 8:
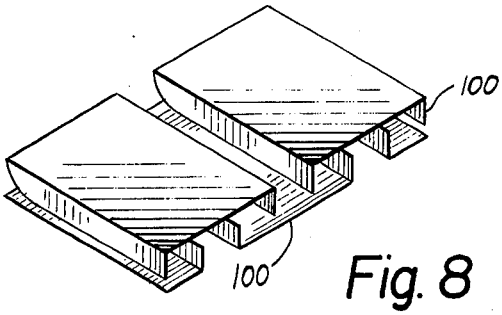

In the embodiment of FIG. 8, a plurality of U-shaped channel members 100 are positioned in oppositely facing, overlapping (or bridging) relationship to define a plurality of separate channels. Quite obviously, other variations and embodiments are within the scope of the present invention.

Figure 9:
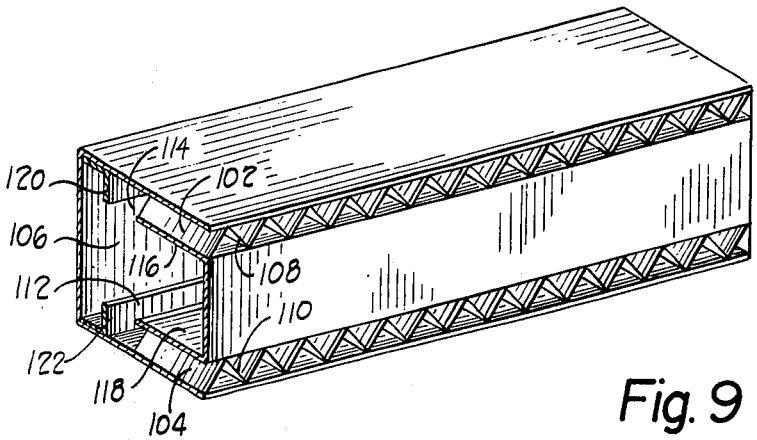
FIGS. 9 and 10 illustrate a further embodiment of the present invention.
Figure 10:
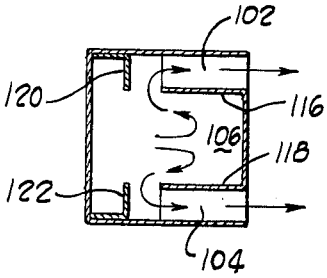

In the embodiment of FIGS. 9 and 10, a pair of nozzles 102 and 104 are positioned in the distribution box, along opposite sides thereof, in communication with a single, centrally located plenum chamber 106. As with the embodiment of FIGS. 2 and 3, the drying air or treating gas is admitted at one end of the distribution box, the distribution box being closed at the opposite end. Flow dividers 108 and 110 are positioned in the nozzles. The nozzles in their lateral dimension, parallel to the orientation of the channels defined by the flow dividers, are not substantially coextensive with the plenum chamber. Instead, the plenum chamber is much enlarged relative the nozzles, and the constricted slot openings 112 and 114 at the inlet end of the nozzle channels are defined by nozzle surfaces 116 and 118 cooperating with longitudinally extending flange members 120 and 122 affixed to the opposite sides of the distribution box.

In an embodiment, the uniformity of flow of treating medium in the adjacent channels of the nozzles 102 & 104, defined by the flow dividers 108 & 110, is enhanced by cutting back on the free end of surfaces 116 & 118. Thus, the flow dividers 108 & 110 extend a short distance into the slot openings 112 & 114 defined by said surfaces and flange members 120 & 122.

What is claimed is:

1. In a longitudinally extending gas treating apparatus including longitudinally moving carrying means for transporting goods to be gas treated through said apparatus, the improvement comprising a gas distribution box for dispensing a gaseous medium in said apparatus, said distribution box comprising at least one plenum chamber having a longitudinal dimension and a transverse dimension, the plenum chamber longitudinal dimension extending laterally within the gas treating apparatus across the width of the goods being treated;

gas inlet means for introducing said gaseous medium into said plenum chamber;

a nozzle substantially coextensive with the plenum chamber in the plenum chamber longitudinal dimension;

means dividing the nozzle into a plurality of parallel, straight channels oriented towards the goods being treated, each channel having an inlet end and an exhaust end; and means defining an elongated, constricted, substantially continuous slot substantially coextensive with the plenum chamber and nozzle communicating the plenum chamber with said channel inlet ends;

the slot being sufficiently narrow to establish a pressure differential between the plenum chamber and the nozzle.

2. The gas treating apparatus of claim 1 in the form of a baking oven for dispensing a heating gas in the baking of goods.

3. The gas treating apparatus of claim 1 wherein said plenum chamber has opposite ends relative said longitudinal dimension, said gaseous medium being introduced at one of said ends, said chamber being tapered in its longitudinal dimension so that it is progressively smaller in cross-section progressing from said one end.

4. The gas treating apparatus of claim 3 wherein the plenum chamber and nozzle are retangular in cross-section taken in a plane perpendicular to the distribution box longitudinal dimension, said box including a longitudinally extending baffle means separating the nozzle from the plenum chamber, said baffle means defining with a wall of the distribution box said constricted slot.

5. The gas treating apparatus of claim 4 wherein said plenum chamber and nozzle are within a single housing which is rectangular in cross-section taken in said transverse dimension.

6. The gas treating apparatus of claim 5 for a baking oven.

7. The gas treating apparatus of claim 5 wherein said nozzle is rectangular in cross-section taken in said lateral dimension, the flow divider means comprising a corrugated baffle interposed in the nozzle having ridges contacting the nozzle sides.

8. The gas treating apparatus of claim 1 wherein said gas inlet means for introducing said gaseous medium into the plenum chamber is positioned intermediate the ends of the plenum chamber with regard to the plenum chamber longitudinal dimension; said distribution box further comprising a second longitudinally extending plenum chamber substantially coextensive with the first mentioned plenum chamber in communication with the gas inlet means, and baffle means defining a longitudinally extending slot between the second plenum chamber and the first mentioned plenum chamber in communication with the gas inlet means, said nozzle being in communication with the second plenum chamber.

9. The gas treating apparatus of claim 1 including a pair of longitudinally extending nozzles spaced along opposite sides of the plenum chamber.

* * * * *